United States Patent [19]

Hagimoto et al.

[11] Patent Number: 4,797,031

[45] Date of Patent: Jan. 10, 1989

[54] CAISSON SINKING METHOD

[75] Inventors: Hakumi Hagimoto; Yutaka Kashima; Norio Kondo; Masami Inoue, all of Tokyo, Japan

[73] Assignee: Daiho Construction Co., Ltd., Tokyo, Japan

[21] Appl. No.: 28,540

[22] Filed: Mar. 20, 1987

[30] Foreign Application Priority Data

Jun. 6, 1986 [JP] Japan ..... 61-132060

[51] Int. Cl.[4] ..... E21D 1/08

[52] U.S. Cl. ..... 405/133; 405/231; 405/267

[58] Field of Search ..... 405/133, 266, 267, 229, 405/236, 233, 132

[56] References Cited

U.S. PATENT DOCUMENTS

| | | | |
|---|---|---|---|
| 933,776 | 9/1909 | Moran et al. | 405/133 |
| 1,049,221 | 12/1912 | Frankignoul | 405/229 |
| 1,100,622 | 6/1914 | Rowley | 405/133 |
| 1,161,512 | 11/1915 | Nitsche | 405/133 X |
| 3,106,068 | 10/1963 | Beckenbauer et al. | 405/133 X |
| 3,262,508 | 7/1966 | Price | 405/133 X |
| 3,452,546 | 7/1969 | Noret | 405/267 |
| 4,180,350 | 12/1979 | Watts | 405/267 |
| 4,496,268 | 1/1985 | Ressi di Cerria | 405/267 X |
| 4,601,615 | 7/1986 | Caralli | 405/267 |
| 4,690,590 | 9/1987 | Nussbaumer et al. | 405/267 |

FOREIGN PATENT DOCUMENTS

| | | | |
|---|---|---|---|
| 152676 | 10/1902 | Fed. Rep. of Germany | 405/133 |
| 259783 | 3/1971 | U.S.S.R. | 405/133 |
| 746912 | 3/1956 | United Kingdom | 405/133 |

*Primary Examiner*—Dennis L. Taylor
*Attorney, Agent, or Firm*—John H. Lynn

[57] ABSTRACT

A caisson sinking method comprises the steps of excavating the ground to make a support ditch having the same plan-view shape as a caisson to be sunk, casting into the excavated ditch a bearing material that can carry the caisson as supported in the ditch but collapses easily by itself, placing entire tapered bottom edge of the caisson on the bearing material cast in the support ditch as aligned therewith, and sequentially removing the bearing material immediately below the bottom edge of the caisson, the caisson being thereby smoothly sunk down to a caisson sinking position without any tilting of the caisson.

1 Claim, 4 Drawing Sheets

G
21
20
22
22'
22''
13
10
11
12
14
t
d

Fig. 4(a)
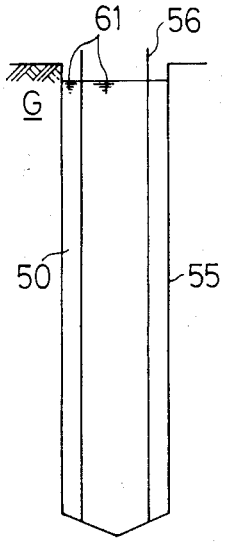
Fig. 4(b)
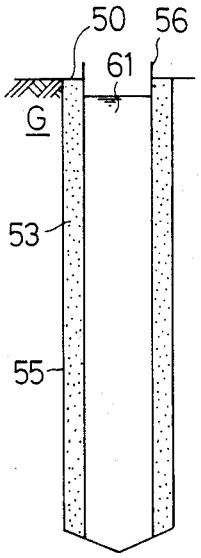
Fig. 4(c)
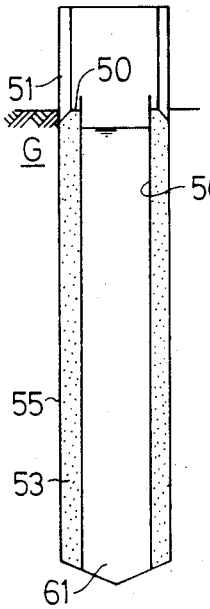
Fig 4(d)
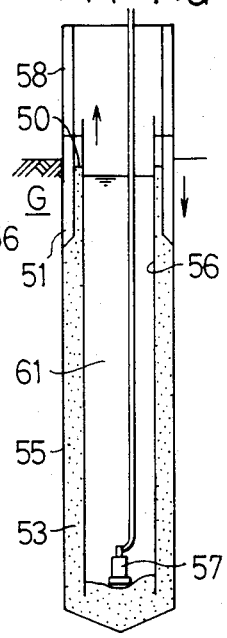
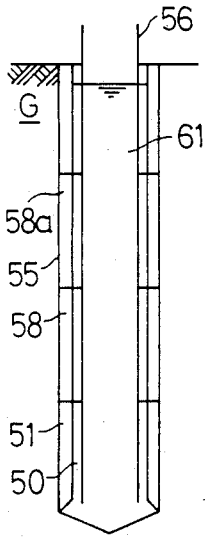
Fig.4(e)
Fig 4(g)
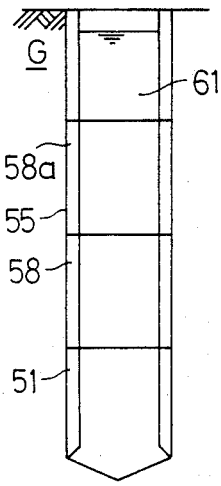
Fig.4(f)
Fig.4(h)
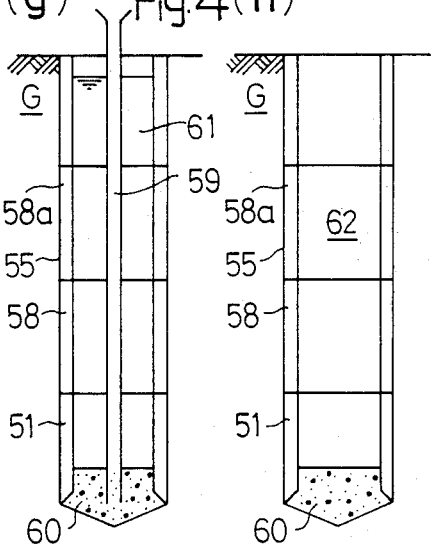

81
74
70

73
70

71
73
70

71
77
73
70
78
71
81
70
73

81
78a
78
71
81
79
78a
78
71
81
78a
82
78
71

CAISSON SINKING METHOD

BACKGROUND OF THE INVENTION

This invention relates to a method of sinking a caisson made of reinforced concrete or the like material into an underground position.

In its broader sense, the method of the invention can be effectively utilized in embedding a tank or the like underground, in forming a vertical shaft into the ground, and so on.

In general, caissons of the type referred to include open and pneumatic caissons, piles for vertical shafts and so on. Such caissons are sunk, for example, by excavating the ground with an excavator, such as a clam bucket to make a relatively deep vertical shaft, placing a tapered bottom edge of the caisson along a peripheral wall that is prepared to be easily collapsible and causing the peripheral wall of the shaft to collapse immediately below the tapered bottom edge of the caisson to sink the caisson. This caisson sinking method has had problems when the ground contains heterogeneous layers or foreign substances, the caisson tends to be tilted, thereby reducing safety and working efficiency.

In an attempt to eliminate the above problem, a method has been suggested in Japanese Patent Publication No. 43532/1983 by T. Nagai et al., wherein many sand or gravel columns are preliminarily constructed vertically through the ground at a site of embedding the caisson. The tapered bottom edge of the caisson is placed on these columns, and the sand or gravel forming the columns and material between the respective sand or gravel columns are removed to sink the caisson gradually. This method reduces the undesirable tilting of the caisson first described above. However, there still remain many problems with the method disclosed by Nagai, et al. so that, even when one tries to sink the caisson with its normal attitude maintained, the safety and working efficiency cannot be improved to a satisfactory extent.

Especially in the caisson sinking arrangement of the Japanese patent publication by Nagai et al., a plurality of circular shafts are made along an annular contour as a whole, and sand or gravel is cast into the respective shafts. Zones still remain between the shafts that may contain heterogeneous materials or foreign matter, which may cause the caisson to be tilted. Yet, as the respective shafts are made to be much larger than the thickness of the tapered bottom edge of the caisson for the purpose of securing a sand or gravel removal zone, the larger inner diameter of the shafts requires the troublesome preliminary step and an increased amount of sand or gravel. This Japanese patent publication is considered to be suitable for use with a large-diametered caisson, but the construction of the plurality of shafts to highly accurately align them along an annular line requires a high degree of control of the excavating positions of the respective shafts.

SUMMARY OF THE INVENTION

A primary object of the present invention is, therefore, to provide a caisson sinking method which can effectively sink the caisson while accurately maintaining the normal attitude of the caisson without any tilting, whereby the required amount of sand or gravel to be cast into the ground for supporting a lower end of the caisson can be remarkably reduced and the sinking method can be simplified to be much safer than the previous methods.

According to the present invention, the above object is attained by providing a method of sinking a caisson, which comprises the steps of excavating a support recess in the ground substantially at a site where the caisson is to be sunk into the ground. The recess is preferably made to have at least the same plan-view shape as the caisson. A bearing material is cast into the support recess. The bearing material can carry the caisson but is easily collapsible by itself to the top of the supporting recess. The caisson is placed on the bearing material cast in the support recess as aligned with the material. The bearing material is sequentially removed is in the support recess to sink the caisson substantially down to a lower end zone of the support recess.

In the above arrangement of the present invention, in particular, the support recess has the same shape as the caisson. The support recess includes therein such bearing material as sand or gravel to face all over the entire bottom end of the caisson. Any heterogeneous soil or foreign substance is removed form the site below the caisson so that the caisson is sunk with its normal attitude being accurately maintained without being tiltid. In addition, if the width of the support recess is set to be equeal to the wall thickness of the caisson, the necessary amount to the bearing material can be reduced to a large extent.

Other objects and advantages of the present invention shall be made clear in the following description of the invention detailed with reference to preferred embodiments shown in accompanying drawings.

BRIEF DESCRIPTION OF THE DRAWINGS

FIGS. 4(*a*) to 4(*h*) are diagrams for explaining caisson sinking steps according to yet another embodiment of the present invention.

DESCRIPTION OF THE PREFERRED EMBODIMENT

Figures 1, 2:
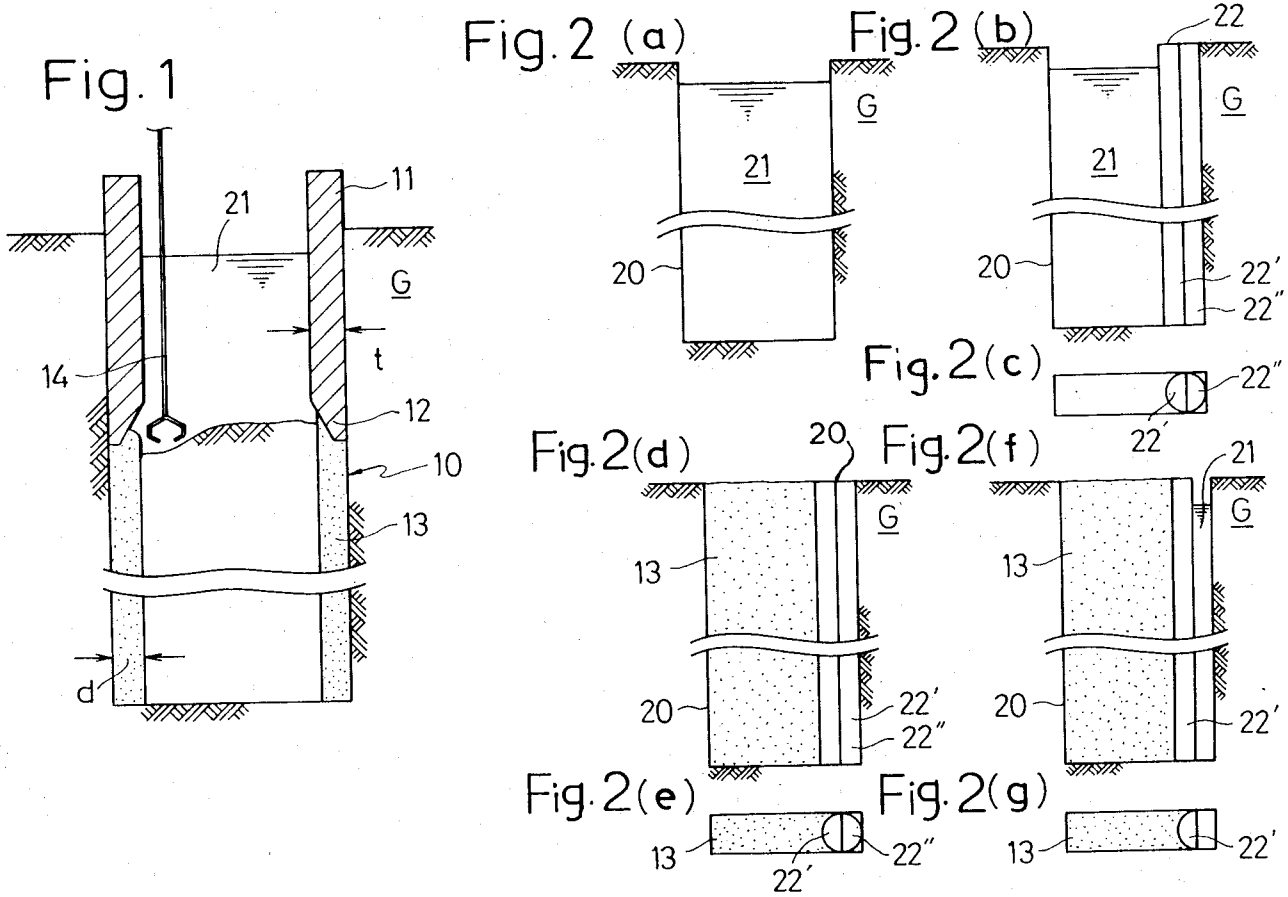
FIG. 1 is a diagram for explaining a method of sinking an open caisson according to an embodiment of the present invention.
FIGS. 2(*a*) to 2(*j*) show steps of forming a support ditch in the caisson sinking method of FIG. 1.
Figure 2H:
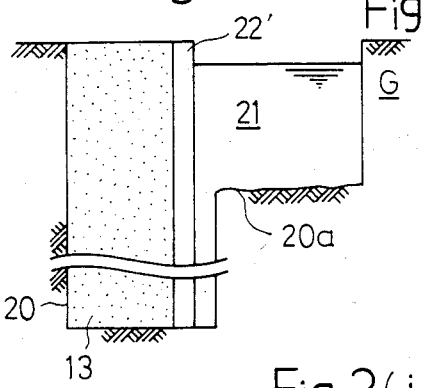
Figure 2I:
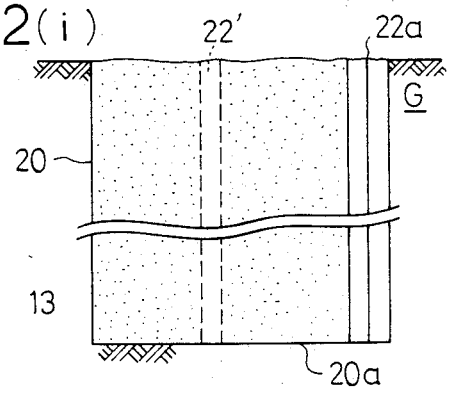
Figure 2J:
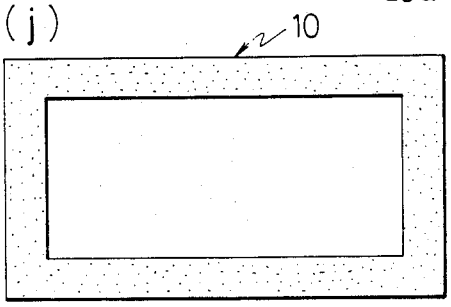

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

Referring to FIG. 1, according to one of novel features of the present invention, a support ditch having the same shape in plan view as an outline of a caisson is formed in the ground where the caisson is to be installed. More specifically, a support ditch 10 is made in conformity to the caisson's s outline to have a width "d" equal to or slightly smaller than a wall thichkness "t" of the caisson 11 to be installed. The support ditch is exavated down to a desired level for installing the caisson 11 at a predetermined position. In the present embodiment, the caisson 11 itself is of an open type which has a tapered bottom edge 12 at its lower end. Upon completion of the excavation of the ditch 10, bearing material 13 such as sand, gravel or the like which can carry the caisson 11 so long as the material is supported in the ditch 10, but otherwise easily collapsing, is cast into the support ditch 10 until the width is thoroughly filled with the material up to its top.

Next, the caisson 11 is placed in the support ditch 10 filled with the bearing material 13. In the illustrated embodiment, the support ditch 10 is substantially of the same plan-view shape as the caisson 11. The caisson 11 is placed on the bearing material 13 cast in the support ditch 10 so that its tapered bottom edge 12 is aligned with the ditch 10. Then, an excavator 14 is inserted into the interior of the open caisson 11 to excavate the ground G surrounded by the support ditch 10 and to remove the excavated ground formation. The advancing excavation causes the bearing material 13 of the support ditch 10 at the level of the excavated ground G to collapse. Therefore, substantially simultaneously with the excavation of the ground G immediately below the caisson 11, the caisson 11 gradually sinks due to its own weight so that, when the ground G is excavated down to the predetermined installation level of the caisson 11, the caisson 11 is sunk and installed eventually at the predetermined level. The excavated ground formation of the ground G and the collapsed bearing material 13 are discharged by a suitable conveying means to the ground surface through the interior of the caisson 11 being sunk.

Because the bearing material 13 collapses only where the inner support wall is lost, the ground G surrounded by the support ditch 10 should be excavated substantially evenly without excessive irregularities, so that the caisson 11 can smoothly sink without substantial tilting. In one case, the bearing material 13 filling the support dtich 10 is made to face the entire tapered bottom edge 12 of the caisson 11, so that the support will not be affected by any heterogeneity in the ground or any foreign matter partly contained in the ground.

In another case, the width "d" of the support ditch 10 is set to be slightly smaller than the wall thickness "t" of the caisson 11 and thus the tapered bottom edge 12 of the caisson 11 partly straddles the ground G. Thus, when the bearing material 13 tends to be somewhat compacted by the width of the caisson 11, the strength of the ground G itself will prevent the caisson 11 from sinking beyond the excavated level of the ground G.

On the other hand, if the ground G is soft and weak, then the width "d" of the support ditch 10 is set to be slightly larger than the wall thickness "t" of the caisson 11. The material having a sufficient bearing ability is employed as the bearing material 13 preferably to support all the bottom edge 12 of the caisson 11 on the bearing material 13. Although, only one excavator 14 has been shown in the drawing to excavate the ground G a plurality of such excavators 14 may be employed.

The following discussion explains the method of forming the support ditch 10 filled with the bearing material 13 in a unique manner according to the present invention. First, a trench 20 as shown in FIG. 2(*a*) is made in a zone of the ground G where the caisson 11 is to be sunk, and the width of the trench 20 is set to be substantially the same as the wall thickness "t" of the caisson 11. In order to prevent any collapse in the ground while boring the trench 20, it is preferable to pour a high concentration of mud water 21 into the trench 20 being bored. Further, as shown in FIGS. 2(*b*) and 2(*c*), an interlocking pipe 22 is built at one longitudinal end of the trench 20. The interlocking pipe 22 preferably comprises a pair of semi-cylindrical members 22' and 22" joined together to form a cylinder as shown. Then, as shown in FIGS. 2(*d*) and 2(*e*), bearing material 13, preferably sand, gravel or mixture thereof is cast into the mud water 21 in the trench 20. Any excessive mud water unabsorbed by the bearing material 13 is discharged out of the trench 20.

Subsequently, as shown in FIGS. 2(*f*) and 2(*g*), the semi-cylindrical member 22" is extracted and, as shown in FIG. 2(*h*), a second stage of trench 20*a* is further made. Next, as shown in FIG. 2(*i*), the similar bearing material 13 is cast into the second stage of trench 20*a*. At the same time, an interlocking pipe 22*a* is built in the trench 20*a*, after which the remaining semi-cylindrical member 22' of the interlocking pipe 20 positioned at the boundary of the first stage of the trench 20 is extracted. In this way, the working steps of FIG. 2(*f*) to 2(*i*) are repetitiously carried out so that the overall layout of the continuous trenches 20 will correspond to the plan-view layout of the caisson 11, to complete, for example, such support ditch 10 as shown in FIG. 2(*j*).

Figure 3A:
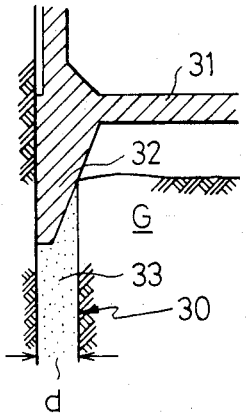
FIGS. 3(*a*) to 3(*c*) are diagrams for explaining a pneumatic caisson sinking method according to another embodiment of the present invention.
Figure 3B:
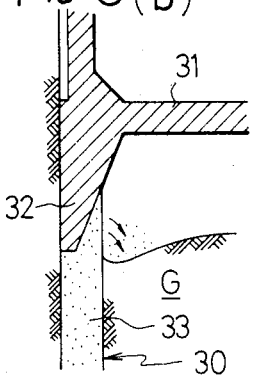
Figure 3C:
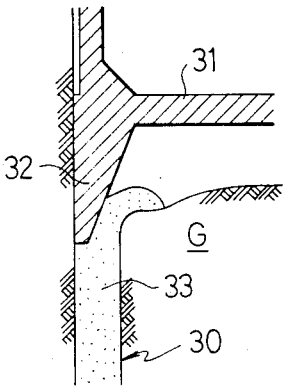

FIGS. 3(*a*) to 3(*c*) show another embodiment of the present invention in which a pneumatic caisson 31 is sunk in the ground G. In the present embodiment, a support ditch 30 is formed to have a width "d" smaller than a tapered bottom edge 32 of the caisson 31, and bearing material 33 is cast into the support ditch 30. Other arrangements and operation of the present embodiment are substantially the same as those of the embodiment of FIGS. 1 and 2.

The present invention can be applied to a formation of a vertical shaft usable for various purposes. In an embodiment shown in FIGS. 4(*a*) through 4(*h*), the ground G is first bored to make a hole 55 of a predetermined depth. A steel pipe 56 of a diameter smaller than the hole 55 is then inserted into the hole 55 until the lower end of the pipe 56 abuts the bottom of the hole 55, thereby defining a supporting ditch 50 between the inner wall of the hole 55 and the outer wall of the steel pipe 56, as seen in FIG. 4(*a*). In the illustrated embodiment, the diameter of the hole 55 is substantially equal to that of the caisson 51. A high concentration of muddy water 61 is poured into the steel pipe 56 and into the supporting ditch 50. Next, as shown in FIG. 4(*b*), substantially the same bearing material 53 as in the foregoing embodiments is cast into the supporting ditch 50. A caisson 51 is placed on material 53 as shown in FIG. 4(*c*). Subsequently, the steel pipe 56 is pulled up slightly by a suitable pull-up means, and the bearing material 53 is sucked from a gap defined between the bottom wall of the hole 55 and the lower end of the steel pipe 56 by sucking means 57, for example, a sand pump. At the same time, a hollow frame 58 equal in diameter to the caisson 51 is mounted on the caisson 51 as shown in FIG. 4(*d*). Such suction of the bearing material 53 causes the caisson 51 and hollow frame 58 to gradually sink, but the high concentration of muddy water having been poured into the steel pipe 56 restrains any fast outflow of the bearing material 53, unduly fast sinking of the caisson, collapse of the boring face of the hole 55, and other adverse action.

Synchronous with the suction of the bearing material 53 and sinking of the caisson 51, new hollow frames 58*a* are sequentially placed on the previously sunk hollow frame 58 and, when the caisson 51 reaches the bottom of the hole 55, the placement of such new hollow frames 58*a* is terminated, as seen in FIG. 4(*e*). At this stage, the caisson 51 and hollow frames 58 and 58*a* are placed against the inner peripheral wall of the hole 55 for its full height. Next, the steel pipe 56 positioned as spaced from the inner peripheral walls of the caisson 51 and hollow frames 58, 58*a* is pulled out of the position by a proper pulling means as seen in FIG. 4(*f*). Then a supply pipe 59, such as a tremie pipe, is inserted into the hole 55. Concrete 60 is cast into the bottom part of the hole 55 as shown in FIG. 4(*g*). Thereafter, the supply pipe 59 and mud water 61 are removed, and a vertical shaft 62 is completed as shown in FIG. 4(*h*).

Figures 5A, 5B, 5C, 5D, 5E, 5F, 5G, 5H:
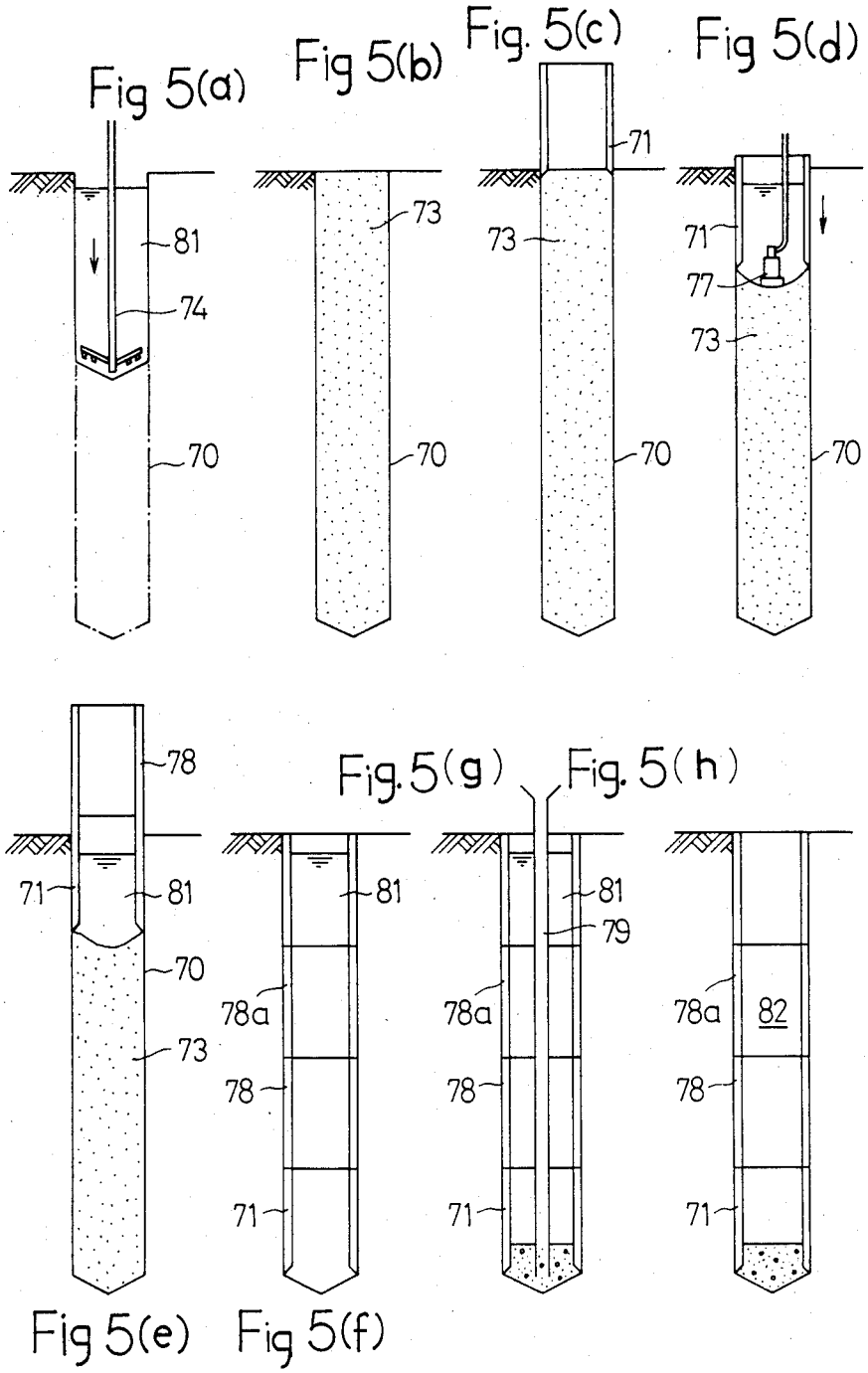
FIGS. 5(*a*) to 5(*h*) are diagrams for explaining caisson sinking steps according to still another embodiment of the present invention.

The embodiment shown in FIG. 4 is suitable for forming the vertical shaft 62 of a relatively large diameter. When it is desired to make a relatively small-diametered shaft, an embodiment of FIG. 5 is preferably employed. More specifically, in the present embodiment, the ground G is first excavated by an excavator 74 to make a vertical supporting hole 70. A high concentration of muddy water 81 is poured into the supporting hole 70 as in FIG. 5(*a*), and then a bearing material 73 is cast into the supporting hole 70, as in FIG. 5(*b*). Subsequently, a ciasson 71 is placed on the bearing material 73 cast in the hole 70, as in FIG. 5(*c*). The bearing material 73 in the supporting hole 70 is sucked from its upper layer by a sucking means 77, e.g., a sand pump as in FIG. 5(*d*). Next, a hollow frame 78 equal in the diameter to the caisson 71 is placed on the caisson 71 as in FIG. 5(*e*). A new hollow frame or frames 78*a* is placed sequentially on the previously placed hollow hollow frame 78 in synchronism with the suction of the bearing material 73 and sinking of the caisson 71 and frames until the caisson 71 reaches the bottom of the supporting hole 70. At this point, the suction of the bearing material 73 and the additional supply of the new hollow frame 78*a* are stopped, as seen in FIG. 5(*f*). As a result, the caisson 71 and hollow frames 78 and 78*a* are provided to the inner peripheral wall of the supporting hole 70 for its full height. A supply pipe 79 is then inserted into the supporting hole 70 to each concrete 80 into the bottom part of the hole 70 as in FIG. 5(*g*). The supply pipe 79 and muddy water 81 are then removed to complete a vertical shaft 81 as seen in FIG. 5(*h*).

Although the bottom part of the support ditch or hole referred to has to be dug down to the caisson sinking position in the foregoing embodiments, it will be readily appreciated by those skilled in the art that, when the caisson sinking position lies in a sand layer or the like, the support ditch or hole may be made only until it is connected to the sand layer but may not be required to be made further down to the sand layer.

What is claimed is:

1. A method of sinking a caisson underground, said method comprising the steps of:

excavating in ground where said caisson is to be sunk a support recess having at least the same shape as the caisson in plan view;

forming said support recess as a ditch made continuously along said shape and down to a caisson sinking position;

forming said support recess to have substantially the same width as a wall thickness of said caisson;

forming said support ditch by sequentially forming trenches reaching down to said caisson sinking position by a method including the steps of:

excavating a first one of said trenches while pouring a high concentration muddy water into excavated part of the trench;

installing a first interlocking pipe at one side end of said trench excavated while casting said bearing material into a remaining part of the trench;

excavating a next trench adjacent to said first trench with said interlocking pipe interposed between them while pouring said muddy water into said next trench being excavated;

installing a second interlocking pipe at one end of said next one of the trenches excavated;

casting said bearing material into a remaining part of the next excavated trench; and extracting said first interlocking pipe between the first and next ones of the trenches;

casting into said support recess up to the top of the support recess, a bearing material that can carry the caisson but easily collapse by itself;

placing said caisson on said bearing material cast in the support recess as aligned with the case material; and sequentially removing the bearing material from the support recess to sink the caisson substantially down to the bottom zone of the support recess.

* * * * *